US008521074B2

(12) United States Patent
Murakami et al.

(10) Patent No.: US 8,521,074 B2
(45) **Date of Patent: *Aug. 27, 2013**

(54) FIXING DEVICE AND IMAGE FORMATION APPARATUS

(75) Inventors: Masanori Murakami, Toyohashi (JP); Fumio Masuda, Sakai (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/397,775

(22) Filed: Feb. 16, 2012

(65) Prior Publication Data

US 2012/0148319 A1 Jun. 14, 2012

Related U.S. Application Data

(63) Continuation of application No. 12/485,092, filed on Jun. 16, 2009, now Pat. No. 8,145,113.

(30) Foreign Application Priority Data

Jun. 19, 2008 (JP) ..... 2008-160575

(51) Int. Cl.
*G03G 15/20* (2006.01)

(52) U.S. Cl.
USPC ..... 399/329; 399/333

(58) Field of Classification Search
USPC ..... 399/329, 333, 330, 331
See application file for complete search history.

(56) References Cited

U.S. PATENT DOCUMENTS 6,021,303 A 2/2000 Terada et al.
7,647,017 B2 1/2010 Uehara et al.

(Continued)

FOREIGN PATENT DOCUMENTS

JP 2003-005549 1/2003
JP 2007-156065 A 6/2007

(Continued)

OTHER PUBLICATIONS

Notification of Reason for Refusal issued in corresponding Japanese Patent Application No. 2008-160575, dated Apr. 27, 2010, and an English Translation thereof.
Notification of Reason for Refusal issued in corresponding Japanese Patent Application No. 2008-160575, dated Nov. 2, 2010, and an English Translation thereof.

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

A fixing device forms a fixing nip by pressing a first roller, which is inside a rotation path of a rotating belt, with a second roller via the belt, and thermally fixes an unfixed image formed on a sheet S by passing the sheet S through the fixing nip while heating the belt by electromagnetic induction. The fixing device includes an excitation coil positioned outside said path, and a fixed plate that (i) is inside the path, substantially facing the excitation coil via the belt, (ii) contacts an inner surface of the belt, and (iii) keeps the belt on the path. A base member of the belt is a conductive heat generation layer containing no magnetic shunt alloy. The fixed plate includes a conductive layer and a magnetic shunt alloy layer that is closer to the belt than the conductive layer.

50 Claims, 9 Drawing Sheets

(56) References Cited

U.S. PATENT DOCUMENTS

| | | | | |
|---|---|---|---|---|
| 7,912,413 | B2 | 3/2011 | Murakami | |
| 8,145,113 | B2 * | 3/2012 | Murakami et al. | 399/329 |
| 2007/0127959 | A1 | 6/2007 | Tatematsu et al. | |
| 2008/0124147 | A1 | 5/2008 | Uehara | |
| 2008/0226324 | A1 | 9/2008 | Baba et al. | |
| 2009/0317155 | A1 | 12/2009 | Murakami et al. | |

FOREIGN PATENT DOCUMENTS

| | | | |
|---|---|---|---|
| JP | 2007-264421 | A | 10/2007 |
| JP | 3988251 | B2 | 10/2007 |
| JP | 2008-129517 | | 6/2008 |

* cited by examiner

FIXING DEVICE AND IMAGE FORMATION APPARATUS

CROSS REFERENCE TO RELATED APPLICATION

This application is a continuation of application Ser. No. 12/485,092, filed Jun. 16, 2009, which claims priority to Japanese Application No. 2008-160575, filed on Jun. 19, 2008, the contents of which are hereby incorporated by reference.

BACKGROUND OF INVENTION (1) Field of the Invention

The present invention relates to an image formation apparatus comprising a fixing device, and in particular to technology for, when performing thermal fixing on a small-sized recording sheet by using an induction heating method, suppressing an excessive temperature increase in portions of a heat generation member that do not come into contact with the small-sized recording sheet.

(2) Description of Related Art

In recent years, fixing devices that utilize compact heat sources of an induction heating type having a relatively high heat conversion efficiency have been used in some image formation apparatuses of an electrophotographic type, or an electrostatic recording type. Such fixing devices draw great attention due to their abilities to conserve energy, save space, reduce a warm-up period, and so on.

In a case where magnetic flux, which is generated by supplying an alternating electric current to an excitation coil, is guided to a conductive heat generation layer by core members (e.g., ferrite cores) so that a specific part of a heat generation member is heated, the heat generation member can be constructed with a significantly small heat capacity. Use of such a heat generation member reduces the warm-up period to a great extent.

With the above structure, however, only a small area of the heat generation member is in contact with other components, with the result that the heat cannot easily be transferred. In this case, if a print job to print on a recording sheet having a small width (hereinafter, "small-sized sheet") is repeated continuously, the temperature of portions of the heat generation member that do not come into contact with the recording sheets (hereinafter, "contactless portions") will be abnormally increased, the contactless portions being outer edges of the heat generation member in the width direction thereof. This may thermally damage or deteriorate components positioned in the vicinity of said contactless portions. Also, in a case where a print job to print on a recording sheet having a large width (hereinafter, "large-sized sheet") is executed immediately after the aforementioned repetition of the print job to print on the small-sized sheet, several defects such as hot offset and uneven glossiness appear on the outer edges of the large-sized sheet in the width direction thereof.

There are methods to suppress a temperature increase in said contactless portions in the above-described fixing device. Such methods include a technique to shield only said contactless portions from the magnetic flux by moving conductive materials in accordance with a sheet width, and a technique to, with use of a degaussing coil, cancel out a part of the magnetic flux over said contactless portions.

The following documents disclose techniques to suppress an excessive temperature increase in said contactless portions by incorporating a magnetic shunt alloy, whose Curie point is somewhat higher than the fixing temperature, into the heat generation member of the above-described fixing device. With the presence of such a magnetic shunt alloy, the heat generation member has the self-temperature control function—i.e., when the temperature of said contactless portions has been increased to the Curie point, said contactless portions automatically turn nonmagnetic, thus reducing the amount of heat generated in the heat generation member.

Japanese Patent Publication No. 3988251 discloses, for example, an image heating device that causes a heat generation layer, which includes a magnetic shunt alloy sublayer, to come into contact with the inner surface of a fixing belt. The fixing belt in this document has a significantly small heat capacity, rendering a warm-up period extremely short. It is further described in this document that, as the self-temperature control is effectively performed, a magnetization member would not get thermally damaged, even when a print job to print on a small-sized sheet has been repeated continuously.

Japanese Patent Application Publication No. 2007-156065 discloses a fixing device including a shield plate that (i) is positioned inside a cylindrical heat generation roller made of a magnetic shunt alloy, extending along an axial direction thereof, and (ii) has a C-shaped cross section. Here, the shield plate is positioned such that an edge of each end portion of the C-shape is closest to the heat generation roller. This structure makes the thermal load on these end portions small, suppresses an excessive temperature increase, reduces a warm-up period, prevents occurrence of an offset, and provides a high-quality fixing performance.

Japanese Patent Application Publication No. 2007-264421 discloses a fixer including a low-resistance plate member that is positioned inside a cylindrical fixing rotary body, extending along an axial direction thereof. The central portion of the low-resistance plate member in the axial direction of the fixing rotary body is thinner than end portions thereof, each of the end portions having a larger thickness than the thickness by which magnetic flux can penetrate thereinto. According to this document, the self-temperature control function is effectively realized particularly on end portions of the fixing rotary body in the width direction thereof. An excessive temperature increase in these end portions can be suppressed without lowering the warm-up performance and heating efficiency of a central portion of the fixing rotary body. It is described in this document that, even when a print job to print on a small-sized sheet has been repeated continuously, the excessive temperature increase in the end portions of the fixing rotary body can be reliably suppressed without causing under-heating on the central portion of the fixing rotary body.

Meanwhile, during a stand-by period (i.e., while the image formation is not being executed), the temperature of a fixing device needs to be maintained at a stand-by temperature from which the fixing device can reach the fixing temperature within a few seconds, so as to promptly perform the fixing whenever an instruction to execute the image formation is issued. Especially, if the fixing device cannot perform the warm-up promptly, it will be essential that the stand-by temperature is high. This is not suitable for energy conservation. Furthermore, if the fixing device cannot perform the warm-up promptly, the user will have to wait for a while after turning on the power of the image formation apparatus, which is not favorable.

By making the fixing device compact in structure and reducing the heat capacity thereof, the fixing device can effectively conserve energy and promptly execute the warm-up. Accordingly, there are demands for yet more compact fixing devices.

A compact fixing device having high heat generation efficiency and a self-temperature control function may seem to be easily constructed by, for example, using a magnetic shunt alloy layer as a base member for the fixing belt, and heating the base member by electromagnetic induction. However, it is not easy to manufacture a fixing belt having a magnetic shunt alloy layer of a uniform thickness. It is not impossible to manufacture such a fixing belt, but it would be difficult for such a fixing belt to have all the essential properties (e.g., temperature characteristics and strength) it should have. Such a fixing belt could be extremely costly as well.

On the other hand, when a base member for the fixing belt is made of a conductive material that is not a magnetic shunt alloy, it is possible to use, as the base member, a conductive material that is relatively easily manufacturable, has excellent properties, and is inexpensive. Such a conductive material can also be heated by electromagnetic induction. For example, when nickel is chosen for the base member, an electroformed nickel belt would be good to use, because it has been manufactured for a long time and widely used, is relatively easily manufacturable, and has great strength.

However, when a conductive material that is not a magnetic shunt alloy is provided as the base member of the fixing belt to serve as a conductive heat generation layer, it is considered that the stated self-temperature control function is difficult to realize using conventional technologies, unlike a case where a conductive material is provided as one of constituents of the fixing belt for assisting the fixing belt in generating heat.

SUMMARY OF THE INVENTION

The present invention aims to provide a fixing device that (i) has a self-temperature control function with the aid of a magnetic shunt alloy, (ii) reduces heat capacity of a heat generation member as compared to conventional technologies, (iii) effectively conserves energy, and (iv) promptly executes the warm-up. The present invention also aims to provide an image formation apparatus comprising such a fixing device. In particular, the present invention aims to provide a fixing device having a self-temperature control function even when a base member for a fixing belt is made of a conductive material that is not a magnetic shunt alloy, and an image formation apparatus comprising such a fixing device.

In order to achieve the above aim, the present invention provides a fixing device for causing a sheet, on which an unfixed image has been formed, to pass through a fixing nip, and thus thermally fixing the unfixed image onto the sheet, the fixing device comprising: a belt that is heated by electromagnetic induction while being driven to rotate; a first roller positioned inside a closed rotation path of the belt; a second roller operable to form the fixing nip between an outer surface of the belt and the second roller, by pressing the first roller from outside the closed rotation path of the belt with the belt in between; an excitation coil positioned outside the closed rotation path of the belt; and a fixed plate that (i) is positioned inside the closed rotation path of the belt, substantially facing the excitation coil with the belt in between, (ii) comes into contact with an inner surface of the belt, and (iii) keeps the belt on the closed rotation path thereof, wherein the belt includes, as a base member, a conductive heat generation layer that (i) generates heat due to an eddy current induced by magnetic flux generated by the excitation coil, and (ii) does not contain a magnetic shunt alloy, and the fixed plate has a layer structure including (i) a conductive layer and (ii) a magnetic shunt alloy layer that is closer to the belt than the conductive layer.

In the above-described fixing device, a conductive material that does not contain a magnetic shunt alloy is used as the base member of the fixing belt, and works as the conductive heat generation layer. In addition, the fixed plate, which is a different component than the fixing belt, includes the conductive layer and the magnetic shunt alloy layer that is layered on the conductive layer. With such a fixing device, an image formation apparatus of the present invention has a self-temperature control function with the aid of the magnetic shunt alloy layer, causes the fixing belt itself to generate heat, and can reduce heat capacity of the fixing belt to a great extent.

Consequently, the image formation apparatus of the present invention can effectively conserve energy and promptly execute the warm-up.

In the present application, the self-temperature control function is realized by (i) incorporating, into the fixing belt, the conductive material that does not contain a magnetic shunt alloy and functions as the conductive heat generation layer, and (ii) providing the magnetic shunt alloy layer to the fixed plate that comes into contact with the inner surface of the fixing belt. The self-temperature control function may seem to be realized more easily by, for example, incorporating a magnetic shunt alloy into the fixing belt and having the magnetic shunt alloy function as the conductive heat generation layer. However, in reality, it is not easy to manufacture a fixing belt with a thin film of magnetic shunt alloy having a uniform thickness, for the following reason. A magnetic shunt alloy is an alloy made of two or more different types of metals. Here, a proportion of constituents (different types of metals) included in the alloy needs to be properly adjusted, so that the magnetic shunt alloy has desired properties (e.g., the Curie point). It is difficult to manufacture a fixing belt having said desired properties while fully furnishing the base member with other properties (e.g., durability) that are imperative therefor.

The present application allows manufacturers to select, out of a variety of conductive materials that are not a magnetic shunt alloy, any material that is highly durable and manufacturable as the base member for the fixing belt. This is realistic in the sense that it offers a wide variety of options to the manufacturers. For example, an endless, electroformed nickel belt can be used. It has been conventionally used for a developing roller and the like. An electroformed nickel belt has been manufactured for a long time and widely used, can be formed into a thin film while maintaining its strength, and is relatively easily manufacturable without a need for an additional equipment, which is extremely cost-friendly. It should be noted here that a belt including a magnetic shunt alloy cannot be manufactured in the same manner as the electroformed nickel belt.

The above fixing device and image formation apparatus may be configured as follows: the magnetic shunt alloy layer is (i) ferromagnetic when a temperature thereof is below a Curie point, and (ii) nonmagnetic when the temperature thereof is equal to or higher than the Curie point; and an amount of heat generated in the conductive heat generation layer when the magnetic shunt alloy layer is nonmagnetic is 80% or less of an amount of heat generated in the conductive heat generation layer when the magnetic shunt alloy layer is ferromagnetic.

According to the above structure, the amount of heat generated in the conductive heat generation layer when the temperature of the magnetic shunt alloy layer is equal to or higher than the Curie point is 80% or less of the amount of heat generated in the conductive heat generation layer when the temperature of the magnetic shunt alloy layer is below the Curie point. Therefore, the above fixing device can achieve a self-temperature control function by suppressing an excessive temperature increase in the contactless portions.

In the above fixing device and image formation apparatus, the conductive heat generation layer may be made of nickel and have a thickness ranging between 10 μm and 100 μm, inclusive.

Since the base member for the fixing belt is made of nickel as stated above, the base member (i) has enough strength in spite of being formed into a thin film, (ii) is relatively easily manufacturable, and (iii) is extremely cost-friendly.

In the above fixing device and image formation apparatus, the magnetic flux generated by the excitation coil may have a frequency ranging between 10 kHz and 30 kHz, inclusive.

According to the above structure, the excitation coil generates magnetic flux having a frequency of 10 kHz to 30 kHz, inclusive. This way, a sufficient amount of heat is generated in the conductive heat generation layer when the temperature of the magnetic shunt alloy layer is below the Curie point, whereas an insufficient amount of heat is generated in the conductive heat generation layer when the temperature of the magnetic shunt alloy layer is equal to or above the Curie point. In other words, the above structure can suppress an excessive temperature increase in the contactless portions.

In the above fixing device and image formation apparatus, the magnetic shunt alloy layer may be made of either a Ni—Fe alloy or a Ni—Fe—Cr alloy, and the Curie point of the magnetic shunt alloy layer may range between 180° C. and 240° C., inclusive.

As stated above, the Curie point of the magnetic shunt alloy layer is 180° C. to 240° C., inclusive. Accordingly, the above structure can prevent defects such as an abnormal temperature increase in the contactless portions, and heat-induced damage or deterioration of components positioned in the vicinity of the contactless portions. Moreover, in a case where a print job to print on a large-sized sheet is executed immediately after a print job to print on a small-sized sheet, the above structure can further prevent defects such as hot offset and uneven glossiness on the outer edges of the large-sized sheet in its width direction.

The above fixing device and image formation apparatus may be configured as follows: the layer structure of the fixed plate is composed of at least three layers, including (i) the conductive layer, (ii) the magnetic shunt alloy layer, and (iii) a low-friction layer that is closer to the belt than any other layer of the fixed plate, the low-friction layer having a smaller coefficient of sliding friction than the magnetic shunt alloy layer while the belt is rotating; and the inner surface of the belt and the low-friction layer slide against each other while the belt is rotating.

The above fixing device and image formation apparatus may be configured as follows: the belt has a layer structure composed of at least two layers, including (i) the base member and (ii) a low-friction layer that is closer to the fixed plate than the base member, the low-friction layer having a smaller coefficient of sliding friction than the base member while the belt is rotating; and the fixed plate and the low-friction layer slide against each other while the belt is rotating.

The above fixing device and image formation apparatus may be configured as follows: the layer structure of the fixed plate is composed of at least three layers, including (i) the conductive layer, (ii) the magnetic shunt alloy layer, and (iii) a first low-friction layer that is closer to the belt than any other layer of the fixed plate, the first low-friction layer having a smaller coefficient of sliding friction than the magnetic shunt alloy layer while the belt is rotating; the belt has a layer structure composed of at least two layers, including (i) the base member and (ii) a second low-friction layer that is closer to the fixed plate than the base member, the second low-friction layer having a smaller coefficient of sliding friction than the base member while the belt is rotating; and the first low-friction layer and the second low-friction layer slide against each other while the belt is rotating.

In the above fixing device and image formation apparatus, the low-friction layer may be made of fluororesin.

The above structure alleviates the friction between the fixing belt and the fixed plate, thus reducing the driving torque of the fixing belt, efficiently conserving energy, and improving durability of the fixing belt and the fixed plate.

The above fixing device and image formation apparatus may be configured such that, in a cross-sectional plane perpendicular to a rotation axis of the first roller, the belt has a substantially elliptical shape satisfying the following relationship: a major axis≦a minor axis×2.

This way, the length of the belt is significantly short as compared to the belt length in Japanese Patent Publication No. 3988251 and Japanese Patent Application Publication No. 2007-156065 that each disclose a belt with two rollers positioned inside a rotation path thereof. Use of the belt according to the above structure is thereby beneficial in reducing heat capacity of a heat generation member, conserving energy, efficiently saving space, reducing a warm-up period, and so on.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF PREFERRED EMBODIMENT

Embodiment 1

<Overview>

Embodiment 1 introduces an image formation apparatus comprising a fixing device that thermally fixes an unfixed image onto a recording sheet by using a heat source of an induction heating type. In the fixing device, a thin film made of nickel is used as a base member for a fixing belt, the base member functioning as a conductive heat generation layer. A fixed plate, which is formed by layering a magnetic shunt alloy layer and a conductive layer, is positioned inside the inner circumference of the fixing belt, in such a manner that the fixed plate faces an excitation coil with the fixing belt in between. Here, the thickness of each layer, as well as the frequency at which magnetic flux generated by the excitation coil is reversed, are respectively set at proper values, in order for the fixing device to have a self-temperature control function, reduce heat capacity of a heat generation member, effectively conserve energy, and promptly and flawlessly execute the warm-up.

<Structure>

Figure 1:
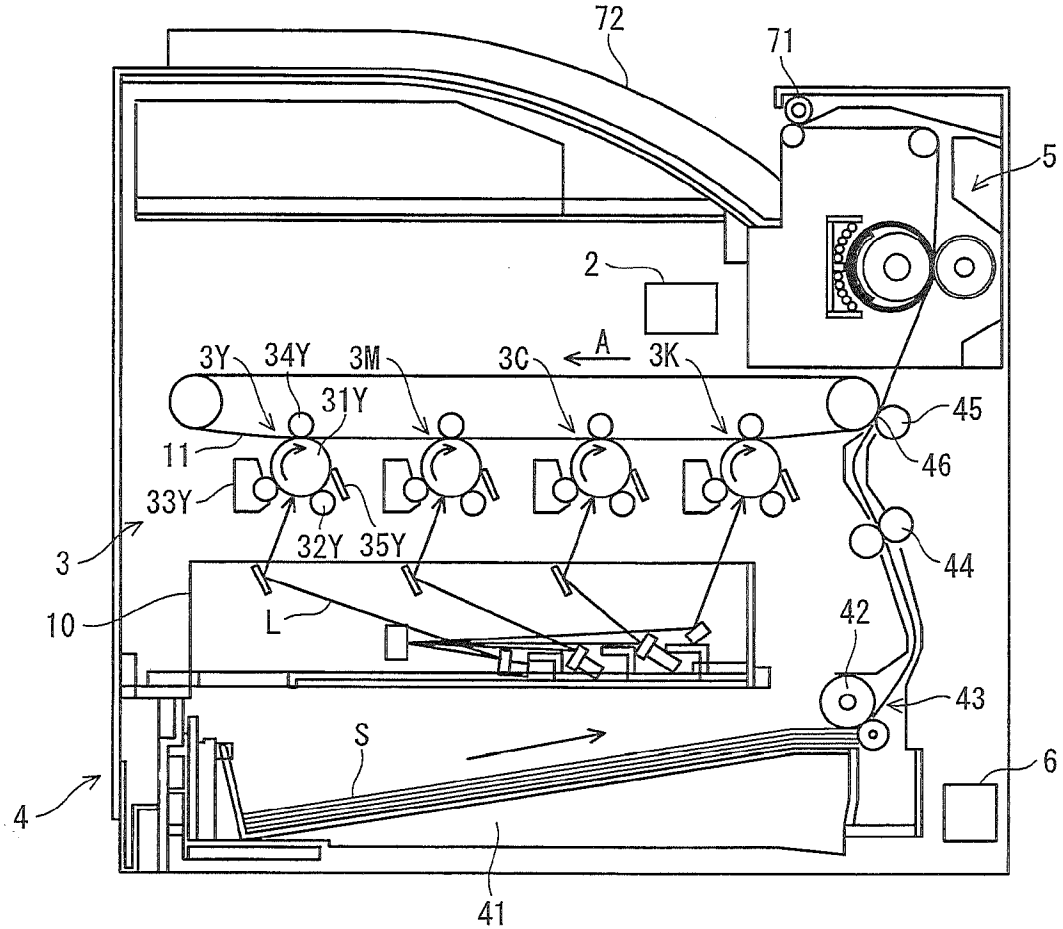
FIG. 1 shows an overall structure of an image formation apparatus pertaining to Embodiment 1.

FIG. 1 shows an overall structure of an image formation apparatus pertaining to the present embodiment.

As shown in FIG. 1, an image formation apparatus 1 pertaining to the present embodiment is a tandem digital color printer composed of an alternating current generator 2, an image processor 3, a feeder 4, a fixing device 5, and a controller 6. The image formation apparatus 1 is connected to a network (e.g., an office LAN). Upon receiving an instruction to execute a print job from a terminal device in the office via the network, the image formation apparatus 1 forms a color image on a recording sheet and then outputs the recording sheet in accordance with the instruction.

The alternating current generator 2 supplies an alternating current of approximately 20 kHz to the excitation coil provided in the fixing device 5.

The image processor 3 is mainly responsible for image formation. In the image processor 3, image formation units 3Y, 3M, 3C, and 3K are arranged in a row in listed order along an intermediate transfer belt 11 which is rotated in the direction of arrow A. The image formation units 3Y, 3M, 3C, and 3K form toner images in yellow, magenta, cyan, and black, respectively. Positioned below the image formation units 3Y to 3K is an optical unit 10 that includes light emitting elements such as laser diodes. In the image processor 3, the image formation unit 3Y, whose major components have reference numbers each followed by the letter "Y", forms an image using yellow toner. Similarly, the image formation unit 3M, whose major components have reference numbers each followed by the letter "M", forms an image using magenta toner. The image formation unit 3C, whose major components have reference numbers each followed by the letter "C", forms an image using cyan toner. The image formation unit 3K, whose major components have reference numbers each followed by the letter "K", forms an image using black toner.

The image formation unit 3Y includes a photosensitive drum 31Y, a charger 32Y, a developer 33Y, a primary transfer roller 34Y, and a cleaner 35Y. The charger 32Y, the developer 33Y, the primary transfer roller 34Y, and the cleaner 35Y are all positioned surrounding the photosensitive drum 31Y.

In order to form an image using yellow toner, the charger 32Y uniformly charges the photosensitive drum 31Y. Under the control of the controller 6, the optical unit 10 applies laser light L to the uniformly charged photosensitive drum 31Y, which forms an electrostatic latent image. The developer 33Y develops the formed electrostatic latent image using the yellow toner. The developed toner image is primary-transferred to the intermediate transfer belt 11. After this primary-transfer, residual toner attached to the photosensitive drum 31Y is removed by the cleaner 35Y.

The image formation units 3M, 3C and 3K are each constructed the same as the image formation unit 3Y (the reference numbers for components of the image formation units 3M, 3C, and 3K are omitted from FIG. 1). Similarly to the image formation unit 3Y, each of the image formation units 3M, 3C, and 3K forms an image using toner of the corresponding color.

The toner image of each color is primary-transferred to the same position on the intermediate transfer belt 11 when said position passes a corresponding one of the image formation units, such that the toner images of different colors are layered on top of one another. These toner images of different colors altogether represent a full-color toner image.

Meanwhile, the feeder 4 is mainly responsible for conveying a recording sheet. The feeder 4 includes: a sheet feed cassette 41 that contains a recording sheet S; a pickup roller 42 that picks up the recording sheet S from the sheet feed cassette 21 and guides the recording sheet S onto a conveyance path 43, one sheet at a time; a pair of timing rollers 44 for adjusting a timing to convey the picked recording sheet S; and a secondary transfer roller 45. Once the recording sheet S has been conveyed to a secondary transfer position 46, the full-color toner image formed on the intermediate transfer belt 11 is secondary-transferred to the recording sheet S at the secondary transfer position 46.

The fixing device 5 is a belt type fixing device. After the full-color toner image has been secondary-transferred to the recording sheet S, the fixing device 5 fixes the full-color toner image onto the recording sheet S by applying heat and pressure to the recording sheet S. Specifics of the fixing device 5 will be described later.

After the fixing, the recording sheet S is discharged to a discharge tray 72 by driving a pair of discharge rollers 71 and the like.

The controller 6 collectively controls the overall operation, temperature adjustment, etc. of the image formation apparatus 1. For each of the image formation units, the controller 6 generates a drive signal for the corresponding light emitting element in the optical unit 10, based on data of the image to be formed. The controller 6 also adjusts timings of accurately layering the toner images of different colors during the primary transfer, and accurately transferring the full-color toner image to the recording sheet S during the secondary transfer.

Figure 2:
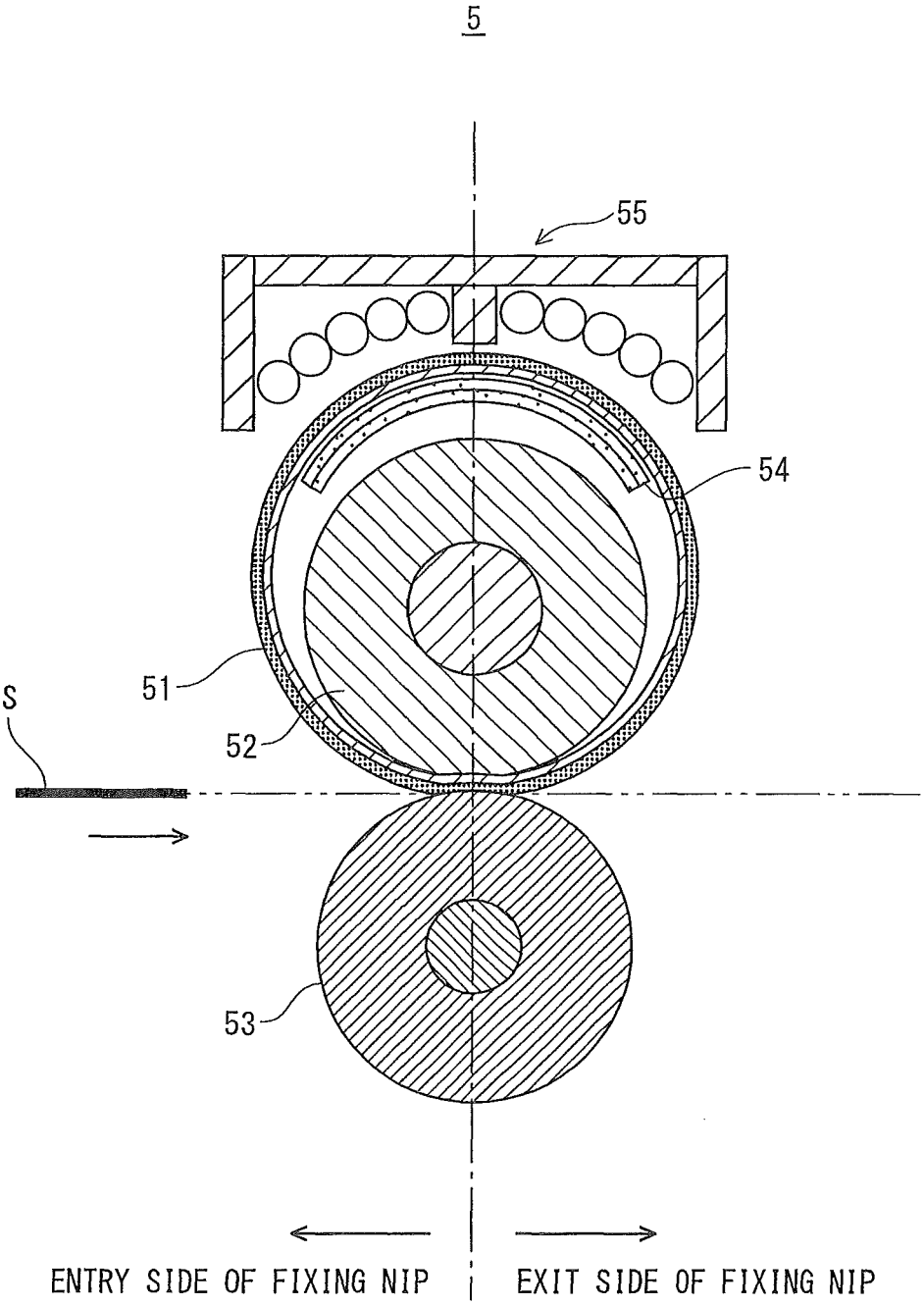
FIG. 2 schematically shows the structure of a fixing device 5.

FIG. 2 schematically shows the structure of the fixing device 5.

As shown in FIG. 2, the fixing device 5 includes a fixing belt 51, a fixing roller 52, a pressure application roller 53, a fixed plate 54, and an excitation coil 55. While heating the fixing belt 51 by electromagnetic induction, the fixing device 5 causes a recording sheet S on which an unfixed image has been formed to pass through a fixing nip between the fixing belt 51 and the pressure application roller 53. This thermally fixes the unfixed image onto the recording sheet S.

The fixing belt 51 is a flexible belt that is driven to rotate. The fixing belt 51 does not contain a magnetic shunt alloy. A base member for the fixing belt 51 is a conductive heat generation layer containing a conductive material that is not a magnetic shunt alloy. The base member for the fixing belt 51 generates heat due to magnetic flux, which is generated by the excitation coil 55, being guided to the base member. This way, the base member functions as the conductive heat generation layer and serves as a heat source used to perform the fixing.

The fixing belt 51 of the present embodiment is an endless belt formed by layering, on the surface of the base member, an elastic layer made of silicone rubber or the like and a releasing layer made of fluoropolymer or the like. The elastic layer helps increase adhesion between the fixing belt 51 and the recording sheet S during the thermal fixing, so as to improve the fixing performance. The releasing layer helps prevent the fixing belt 51 from being stuck to the recording sheet S and the pressure application roller 53. In a cross-sectional plane perpendicular to the rotation axis of the fixing roller 52, the fixing belt 51 has a substantially elliptical shape satisfying the following relationship: the major axis≦the minor axis×2.

Positioned inside the rotation path of the fixing belt 51, the fixing roller 52 is formed by layering an elastic thermal insulation layer made of silicone rubber or silicone sponge on the outer circumference of a cylindrical core shaft made of steel or aluminum.

The pressure application roller 53 forms a fixing nip between itself and the surface of the fixing belt 51, by pressing the fixing roller 52 from outside the rotation path of the fixing belt 51 with the fixing belt 51 in between. The pressure application roller 53 is formed by layering the following on the outer circumference of a core shaft (e.g., a cylindrical iron and an aluminum pipe): an elastic thermal insulation layer made of silicone rubber etc.; a releasing layer made of fluoropolymer etc.; and the like.

The fixed plate 54 is positioned inside the rotation path of the fixing belt 51, such that (i) it is not in the vicinity of the fixing nip, (ii) it comes into contact with the inner surface of the fixing belt 51, and (iii) it substantially faces the excitation coil 55 with the fixing belt 51 in between. The fixed plate 54 is fixed in position so that, while the fixing belt 51 is rotating, the fixed plate 54 slides against the inner surface of the fixing belt 51 and keeps the fixing belt 51 on the rotation path thereof. The fixed plate 54 has a layer structure composed of at least two layers, including (i) a magnetic shunt alloy layer and (ii) a low-resistance conductive layer that is farther away from the fixing belt 51 than the magnetic shunt alloy layer. By thus layering the magnetic shunt alloy layer and the low-resistance conductive layer, components positioned inside the rotation path of the fixing belt 51 can be reduced in size, and the length of the fixing belt 51 can thereby be reduced.

The excitation coil 55 is positioned outside the rotation path of the fixing belt 51, facing the fixed plate 54 with the fixing belt 51 in between. The excitation coil 55 generates magnetic flux toward the fixing belt 51 and the fixed plate 54. In the present embodiment, by the alternating current generator 2 (shown in FIG. 1) supplying an alternating current of approximately 20 kHz to the excitation coil 55, the excitation coil 55 generates magnetic flux that reverses at a frequency of approximately 20 kHz.

As set forth above, the fixing device 5 pertaining to the present embodiment includes the fixing roller 52 and the fixed plate 54 positioned inside the rotation path of the fixing belt 51. Japanese Patent Publication No. 3988251 and Japanese Patent Application Publication No. 2007-156065 each disclose a fixing belt with two rollers positioned inside a rotation path thereof; compared to this fixing belt, the length of the fixing belt 51 pertaining to the present embodiment is significantly short. Hence, use of such a fixing belt is considerably beneficial in reducing heat capacity of the heat generation member, conserving energy, efficiently saving space, reducing a warm-up period, and so on.

The following describes the material, thickness, etc. of each layer in detail.

Figure 3:
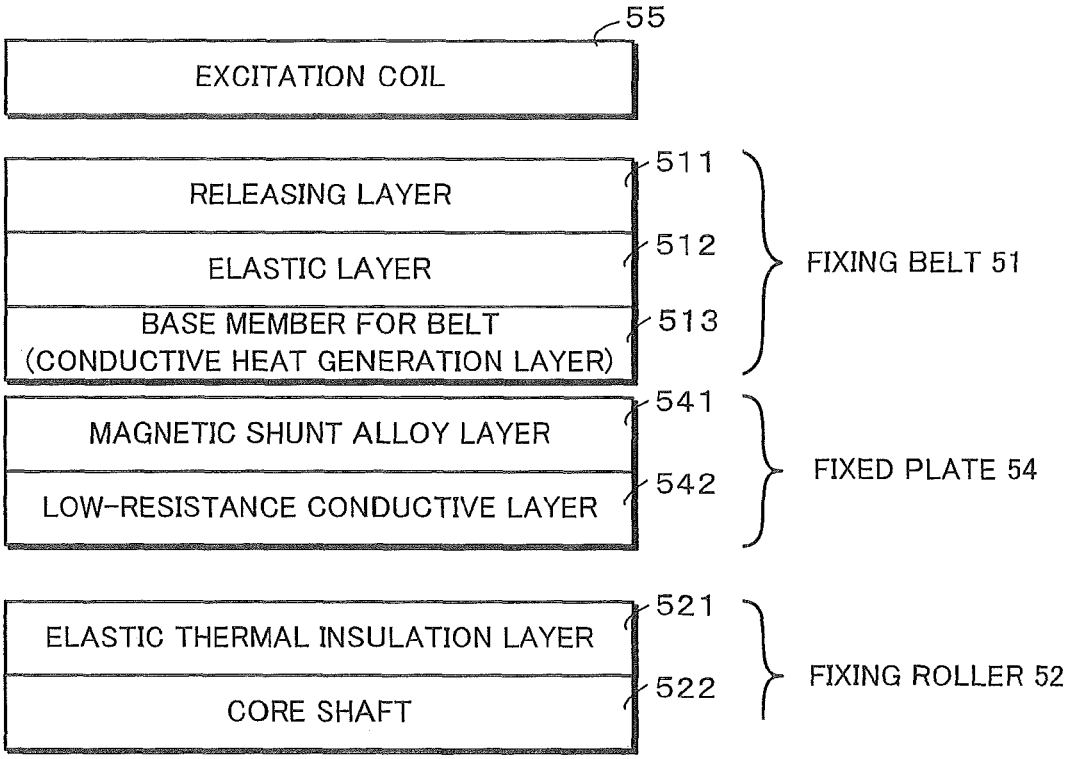
FIG. 3 is a schematic view of layer structures, showing the center of a fixing roller 52 through an excitation coil 55.

FIG. 3 is a schematic view of layer structures, showing the center of the fixing roller 52 through the excitation coil 55.

As shown in FIG. 3, the center of the fixing roller 52 is the innermost of the layer structures, and the excitation coil 55 is the outermost of the layer structures. Below the excitation coil 55 is the fixing belt 51 formed by layering a base member 513, an elastic layer 512 and a releasing layer 511 in listed order, so that the releasing layer 511 is closest to the excitation coil 55. Below the fixing belt 51 is the fixed plate 54 formed by layering a magnetic shunt alloy layer 541 on a low-resistance conductive layer 542. Below the fixed plate 54 is the fixing roller 52 constituted from an elastic thermal insulation layer 521 and a core shaft 522. There is a clearance between the excitation coil 55 and the fixing belt 51. The fixing belt 51 and the fixed plate 54 are in contact with each other. There is a clearance between the fixed plate 54 and the fixing roller 52 as well.

The releasing layer 511 of the present embodiment is made of PFA. The releasing layer 511 needs to be made of a material that (i) is resistant to the fixing temperature during use, and (ii) has an excellent toner-releasing property. For example, it is preferable that the releasing layer 511 be made of silicone rubber and fluoropolymer such as fluororubber, PFA, PTFE, PEP, and PFEP.

The releasing layer 511 of the present embodiment has a thickness of 30 μm. In terms of durability and energy conservation, it is preferable that the releasing layer 511 have a thickness of 5 μm to 100 μm, inclusive. For practical use, it is further preferable that the releasing layer 511 have a thickness of 5 μm to 50 μm, inclusive.

The elastic layer 512 of the present embodiment is made of silicone rubber. The elastic layer 512 needs to be made of a material that has thermostability and elasticity. For example, the elastic layer 512 may be made of a thermostable elastomer such as silicone rubber and fluororubber, which would be resistant to the fixing temperature during use. Filler may be added to the above-mentioned elastomer, for the purpose of improving pyroconductivity of the elastic layer 512 and reinforcing the same. In terms of workability and cost, it is preferable for practical use that the filler be silica, alumina, magnesium oxide, boron nitride, beryllium oxide, etc. Alternatively, in terms of properties, diamond, silver, copper, aluminum, marble, glass, etc. may be used as filler as well.

The elastic layer 512 of the present embodiment has a thickness of 200 μm. In order for the elastic layer 512 to have sufficient elasticity in its thickness direction, it is preferable that the elastic layer 512 have a thickness of 10 μm or greater. However, if the thickness of the elastic layer 512 is greater than 800 μm, it will be hard for the heat generated in the base member to be transferred to the recording sheet S, and thermal efficiency of the fixing belt 51 will thus be reduced. In other words, the elastic layer 512 having a thickness greater than 800 μm is undesirable. For this reason, it is preferable that the elastic layer 512 have a thickness of 10 μm to 800 μm, inclusive. For practical use, it is further preferable that the elastic layer 512 have a thickness of 100 μm to 300 μm, inclusive.

In the present embodiment, the base member 513 of the fixing belt 51 is an endless, electroformed nickel belt. The base member 513 not only helps the fixing belt 51 maintain its form, but also serves as a conductive heat generation layer used for a fixing device of an induction heating type. It is relatively easy to manufacture a fixing belt whose base member is made from a thin nickel film. Furthermore, such a fixing belt is highly durable and strong, and has considerably small heat capacity since it does not require reinforcement materials such as a resin material. Such a fixing belt is thus suitable for use in a fixing device. Alternatively, the base member 513 may be made from a magnetic material (e.g., magnetic metal such as magnetic stainless steel) that has relatively high magnetic permeability μ and decent resistivity ρ. Alternatively, the conductive heat generation layer may be made of, for example, a nonmagnetic metallic material with high conductivity, such as Cu (copper) and Al (aluminum). In this case, a required amount of heat can be generated by forming the conductive heat generation layer into a thin film having a thickness of approximately 15 μm, so as to increase the resistance of the conductive heat generation layer. However, in a case where, for example, said thin film is not strong enough, a resin material may be used for reinforcement. Furthermore, particles of a highly conductive material may be dispersed in the resin material.

The base member 513 of the present embodiment has a thickness of 40 μm. In a case where the fixing belt 51 is an electroformed nickel belt, the base member 513 may easily (i) cause the fixing belt 51 to crack if the thickness of the base member 513 were smaller than 10 μm, or (ii) have a poor sheet-releasing property if the thickness of the base member 513 were greater than 100 μm. For this reason, it is preferable that the base member 513 have a thickness of approximately 10 μm to 100 μm, inclusive. In terms of manufacturability, tractability, etc. of the fixing belt 51, it is further preferable for practical use that the base member 513 have a thickness of 20 μm to 50 μm, inclusive.

The magnetic shunt alloy layer 541 of the present embodiment is a magnetic shunt alloy made of Ni (nickel) and Fe (iron). The Curie point of the magnetic shunt alloy layer 541 is 220° C. Alternatively, the magnetic shunt alloy layer 51 may be a Ni—Fe—Cr (chrome) alloy. A magnetic shunt alloy has the property that it is ferromagnetic when the temperature thereof is below the Curie point, but turns nonmagnetic when the temperature thereof has reached or exceeded the Curie point. The Curie point can be arbitrarily set within a predetermined range by adjusting a proportion of constituents included in the alloy. Furthermore, it is preferable that the Curie point be set within a range from 180° C. to 240° C., inclusive. It is further preferable that the Curie point be set at approximately 220° C.

The magnetic shunt alloy layer 541 of the present embodiment has a thickness of 200 μm. In a case where the magnetic shunt alloy layer 541 is a Ni—Fe alloy, it is preferable that the magnetic shunt alloy layer 541 have a thickness of approximately 50 μm to 400 μm, inclusive. For practical use, it is further preferable that the magnetic shunt alloy layer 541 have a thickness of 100 μm to 300 μm, inclusive.

The low-resistance conductive layer 542 of the present embodiment is made of Cu. Alternatively, the low-resistance conductive layer 542 may be made of any material with high conductivity, as long as it has a certain degree of thickness and low resistance.

The low-resistance conductive layer 542 of the present embodiment has a thickness of 200 μm. It is preferable that the low-resistance conductive layer 542 have a thickness of approximately 50 μm to 400 μm, inclusive. For practical use, it is further preferable that the low-resistance conductive layer 542 have a thickness of 100 μm to 300 μm, inclusive.

When the temperature of the magnetic shunt alloy layer 541 is below the Curie point, the magnetic shunt alloy layer 541 captures magnetic flux, and the magnetic flux does not reach the low-resistance conductive layer 542. The magnetic flux that has penetrated into the base member 513 causes the base member 513 to generate heat.

The heat generated in the base member 513 is used to perform the thermal fixing, and also transferred to the magnetic shunt alloy layer 541.

When the temperature of the magnetic shunt alloy layer 541 has reached or exceeded the Curie point, the magnetic shunt alloy layer 541 turns nonmagnetic and becomes unable to capture the magnetic flux. As a result, the magnetic flux penetrates through the magnetic shunt alloy layer 541 and reaches the low-resistance conductive layer 542. As the low-resistance conductive layer 542 has low resistance, even if the magnetic flux has reached the low-resistance conductive layer 542, the amount of heat generated therein would be small. At this time, however, the low-resistance conductive layer 542 generates a magnetic field of the opposite direction, which cancels out the magnetic flux that has been originally generated. This consequently reduces the amount of the magnetic flux penetrating through the base member 513, and therefore the amount of heat generated in the base member 513.

The above-described principle enables suppression of the temperature increase in contactless portions while performing the thermal fixing on a small-sized sheet.

The elastic thermal insulation layer 521 of the present embodiment is made of silicone sponge. The elastic thermal insulation layer 521 thermally insulates the fixing belt 51, maintains the form of the fixing belt 51, and secures a nip width by allowing the fixing belt 51 to be flexible. The elastic thermal insulation layer 521 may have a double-layer structure including a rubber layer and a sponge layer. This gives the elastic thermal insulation layer 521 a high thermal insulation property and sufficient elasticity in a relatively easy way.

The elastic thermal insulation layer 521 of the present embodiment has a thickness of 10 mm. In a case where the elastic thermal insulation layer 521 is made of silicone sponge, the elastic thermal insulation layer 521 preferably has a thickness of 2 mm to 15 mm inclusive, or more preferably, 8 mm to 12 mm inclusive. Furthermore, when measured by the ASKER Durometer, the elastic thermal insulation layer 521 preferably has a hardness of 20 points to 60 points inclusive, or more preferably, 30 points to 50 points inclusive.

The core shaft 522 of the present embodiment is made of aluminum. Alternatively, the core shaft 522 may be made of steel or a molded thermostable pipe, such as PPS (polyphenylene sulfide), as long as the core shaft 522 preserves its strength. It should be noted here that the core shaft 522 is preferably made of a nonmagnetic material, so as not to generate heat due to leaked magnetic flux.

The core shaft 522 of the present embodiment has a diameter of 10 mm.

Figure 4:
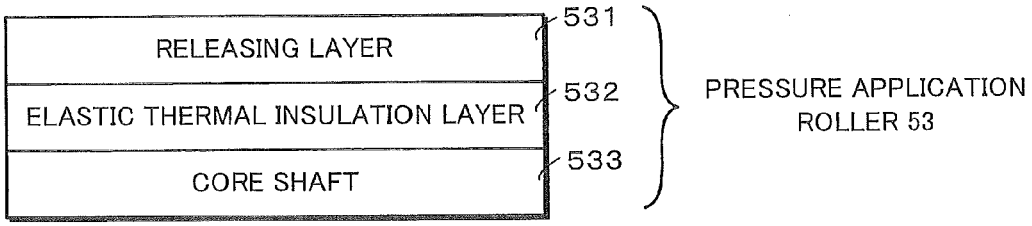
FIG. 4 is a schematic view of a layer structure of a pressure application roller 53.

FIG. 4 is a schematic view of a layer structure of the pressure application roller 53.

As shown in FIG. 4, the pressure application roller 53 is formed by layering a core shaft 533, an elastic thermal insulation layer 532 and a releasing layer 531 in listed order, so that the releasing layer 531 is the outermost of the layer structure.

The releasing layer 531 of the present embodiment is made of fluoropolymer such as PTFE and PFA. The releasing layer 531 may be made of any material that enhances the releasing property of the surface of the releasing layer 531.

The releasing layer 531 of the present embodiment has a thickness of 20 μm. In a case where the releasing layer 531 is made of fluoropolymer, the releasing layer 531 preferably has a thickness of approximately 10 μm to 50 μm, inclusive.

The material and the thickness of the elastic thermal insulation layer 532 are the same as those of the elastic thermal insulation layer 521 of the fixing roller 52, respectively.

The material and the diameter of the core shaft 533 are the same as those of the core shaft 522 of the fixing roller 52, respectively.

<Results of Experiments>

The following facts were confirmed from experiments.

(1) Inventors of the present invention (hereinafter, "the inventors") conducted an experiment under Condition 1, in which (i) a conductive heat generation layer (the base member 513) was made of nickel and had a thickness of 40 μm, (ii) the fixing device included neither a magnetic shunt alloy layer nor a low-resistance conductive layer, and (iii) the frequency at which the magnetic flux is reversed was set at 40 kHz. In this experiment, although a sufficient amount of heat was generated, due to the absence of a magnetic shunt alloy layer, the fixing device obviously did not have the self-temperature control function.

(2) The inventors conducted another experiment under Condition 2, in which (i) a conductive heat generation layer (the base member 513) was made of nickel and had a thickness of 40 μm, (ii) a magnetic shunt alloy layer was made of a Ni—Fe alloy and had a thickness of 200 μm, (iii) a low-resistance conductive layer was made of copper and had a thickness of 200 μm, and (iv) the frequency at which the magnetic flux is reversed was set at 40 kHz. In this experiment, a sufficient amount of heat was generated not only when the temperature of the magnetic shunt alloy layer was below the Curie point, but also when the temperature of the magnetic shunt alloy layer was equal to or higher than the Curie point. In other words, the fixing device did not have the self-temperature control function in this experiment.

(3) The inventors conducted yet another experiment under Condition 3, in which (i) a conductive heat generation layer (the base member 513) was made of nickel and had a thickness of 40 μm, (ii) the fixing device included neither a magnetic shunt alloy layer nor a low-resistance conductive layer, and (iii) the frequency at which the magnetic flux is reversed was set at 20 kHz. In this experiment, neither was a sufficient amount of heat generated, nor did the fixing device have the self-temperature control function due to the absence of a magnetic shunt alloy layer.

(4) The inventors conducted yet another experiment under Condition 4, in which (i) a conductive heat generation layer (the base member 513) was made of nickel and had a thickness of 40 μm, (ii) a magnetic shunt alloy layer was made of a Ni—Fe alloy and had a thickness of 200 μm, (iii) a low-resistance conductive layer was made of copper and had a thickness of 200 μm, (iv) and the frequency at which the magnetic flux is reversed was set at 20 kHz. In this experiment, a sufficient amount of heat was generated when the temperature of the magnetic shunt alloy layer was below the Curie point, but not when the temperature of the magnetic shunt alloy layer was equal to or higher than the Curie point. In other words, the fixing device had a self-temperature control function in this experiment.

It has been confirmed from results of the aforementioned experiments that Condition 4 allows generating a sufficient amount of heat and provides the fixing device with a self-temperature control function.

<Operating Principles>

Having conducted several simulations, the inventors provide the following views.

Figure 5A:
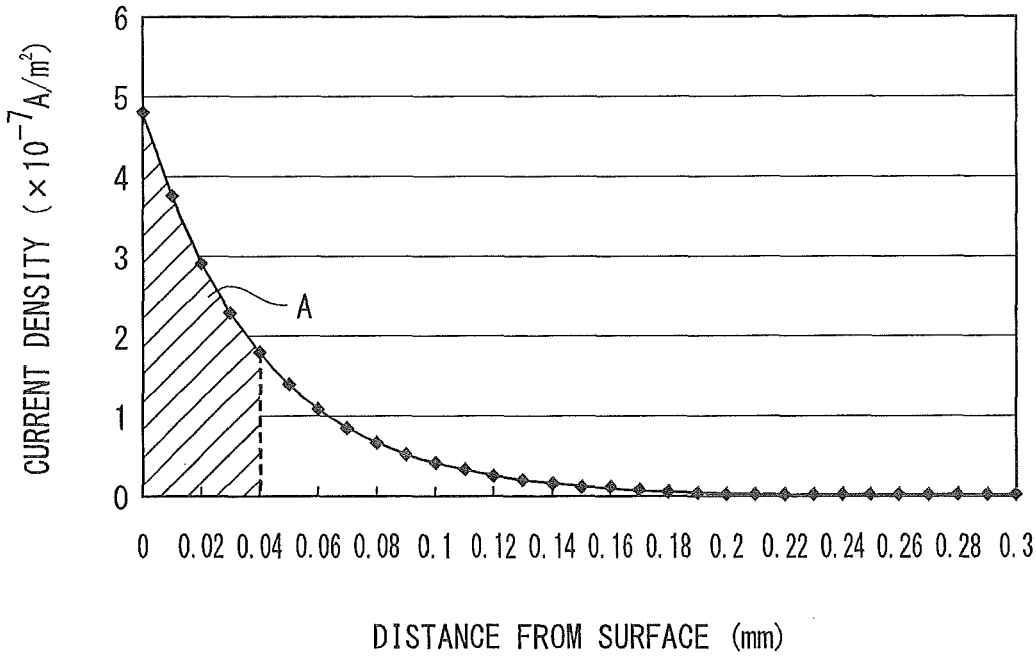
FIGS. 5A and 5B each show a simulated relationship between (i) a distance from the surface of a heat generation member and (ii) current density, where magnetic fluxes with different reversion frequencies are applied to a conductive heat generation layer with the presence of neither a magnetic shunt alloy layer nor a low-resistance conductive layer.
Figure 5B:
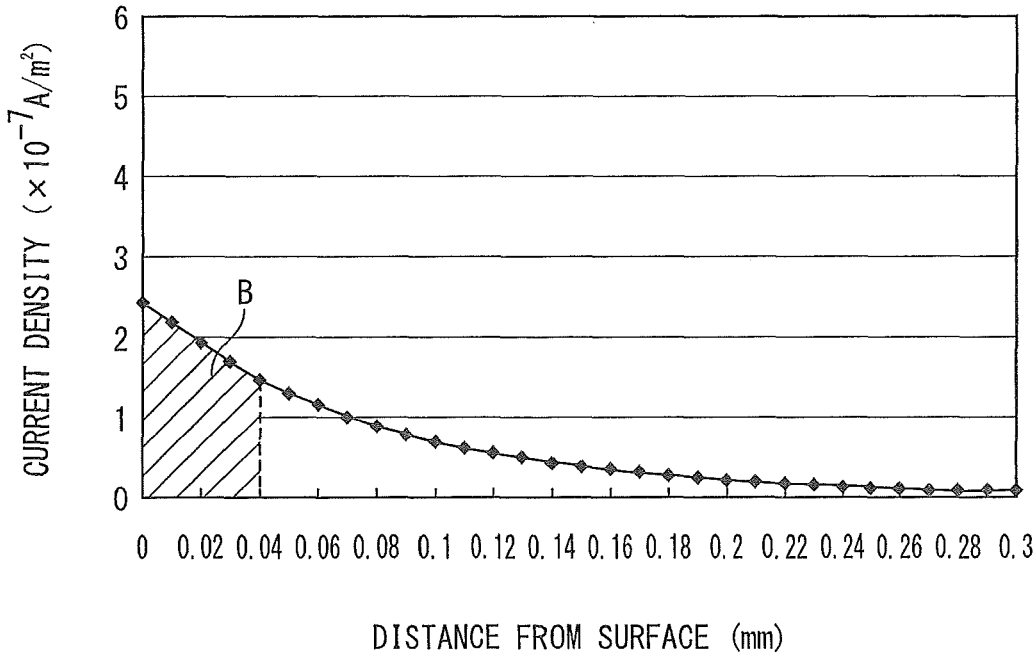
Figure 6A:
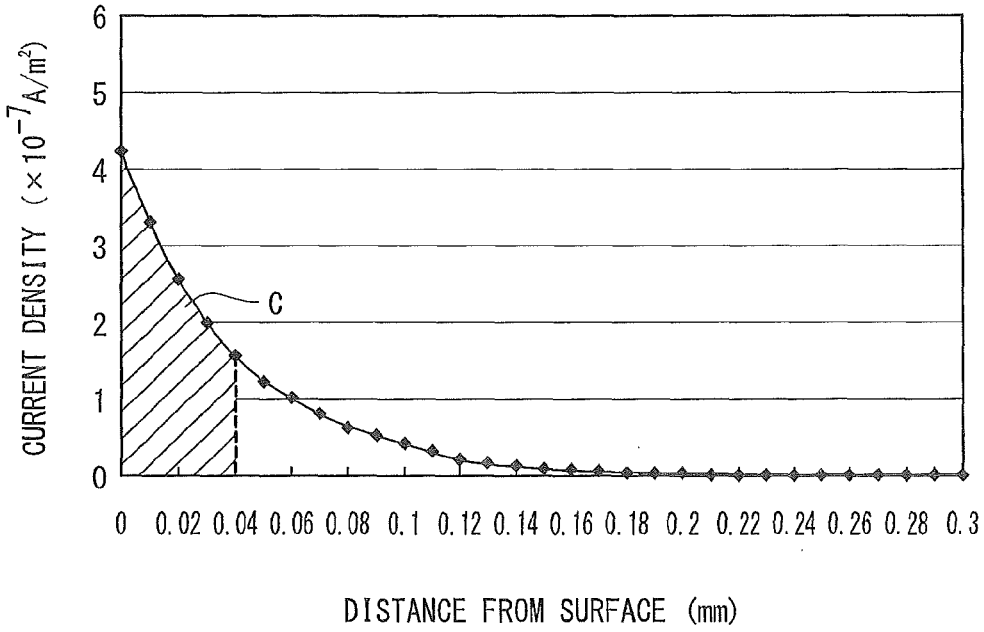
FIGS. 6A and 6B each show a simulated relationship between (i) a distance from the surface of a heat generation member and (ii) current density, where the relationship of FIG. 6A is obtained when the temperature of the heat generation member is equal to or above the Curie point, and the relationship of FIG. 6B is obtained when the temperature of the heat generation member is below the Curie point.
Figure 6B:
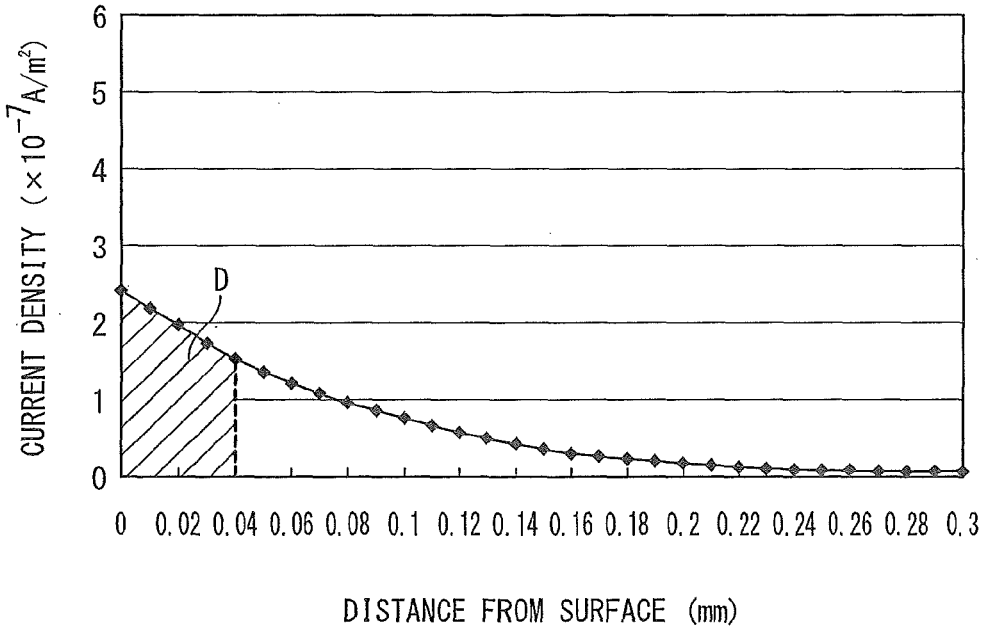

FIGS. 5A, 5B, 6A, and 6B each show a simulated relationship between (i) a distance from the surface of a heat generation member and (ii) current density. Here, in examples of FIGS. 5A and 5B, magnetic fluxes with different reversion frequencies are applied to the conductive heat generation layer with the presence of neither the magnetic shunt alloy layer nor the low-resistance conductive layer. On the other hand, the relationship of FIG. 6A is obtained when the temperature of the heat generation member is equal to or above the Curie point, and the relationship of FIG. 6B is obtained when the temperature of the heat generation member is below the Curie point.

In each of FIGS. 5A, 5B, 6A, and 6B, the heat generation member is made of Ni and has a thickness of 40 μm. An area enclosed by a certain interval, the X-axis, and a line chart represents an amount of heat generated in said certain interval that is a depth from the surface of the heat generation member. As the heat generation member has a thickness of 40 μm, a hatched area enclosed by (i) an interval of 0 mm to 0.04 mm from the surface, (ii) the X-axis, and (iii) the line chart represents an amount of heat generated in the heat generation member.

FIG. 5A shows a simulated relationship between (i) a distance from the surface of the heat generation member and (ii) the current density, the relationship being obtained under the aforementioned Condition 1 (i.e., the fixing device includes neither a magnetic shunt alloy layer nor a low-resistance conductive layer, and the frequency at which the magnetic flux is reversed is set at 40 kHz). Referring to FIG. 5A, a hatched area A represents an amount of heat generated by the heat generation member. Judging from the size of this hatched area A, a sufficient amount of heat is generated here.

Conventional fixing devices of an induction heating type have been constructed under Condition 1, i.e., they do not utilize a magnetic shunt and thereby do not have a self-temperature control function. However, even when such conventional fixing devices were constructed under a combination of Conditions 1 and 2 (i.e., even when a magnetic shunt alloy layer and a low-resistance conductive layer were provided below the heat generation member), the heat generation member would still generate a large amount of heat after the magnetic shunt alloy layer turns nonmagnetic as a result of its temperature reaching or exceeding the Curie point. That is to say, even when constructed under the combination of Conditions 1 and 2, such fixing devices would not have the self-temperature control function.

FIG. 5B shows a simulated relationship between (i) a distance from the surface of the heat generation member and (ii) the current density, the relationship being obtained under the aforementioned Condition 3 (i.e., the fixing device includes neither a magnetic shunt alloy layer nor a low-resistance conductive layer, and the frequency at which the magnetic flux is reversed is set at 20 kHz). Referring to FIG. 5B, a hatched area B represents an amount of heat generated by the heat generation member. Judging from the size of this hatched area B, an insufficient amount of heat is generated here.

FIG. 6A shows a simulated relationship between (i) a distance from the surface of the heat generation member and (ii) the current density, the relationship being obtained under the aforementioned Condition 4, as well as in the present Embodiment (i.e., the fixing device includes a magnetic shunt alloy layer and a low-resistance conductive layer both having a thickness of 200 μm, and the frequency at which the magnetic flux is reversed is set at 20 kHz), while the temperature of the magnetic shunt alloy layer is below the Curie point. Referring to FIG. 6A, a hatched area C represents an amount of heat generated by the heat generation member. Judging from the size of this hatched area C, a sufficient amount of heat is generated here.

FIG. 6B shows a simulated relationship between (i) a distance from the surface of the heat generation member and (ii) the current density, the relationship being obtained under the aforementioned Condition 4, as well as in the present Embodiment, while the temperature of the magnetic shunt alloy layer is equal to or higher than the Curie point. Referring to FIG. 6B, a hatched area D represents an amount of heat generated by the heat generation member. Judging from the size of this hatched area D, an insufficient amount of heat is generated here.

The following conclusions can be drawn from FIGS. 5A, 5B, 6A, and 6B. When a Ni layer having a thickness of 40 μm is exposed to magnetic flux that is reversed at a frequency of 40 kHz, a sufficient amount of heat is generated, but the fixing device does not have a self-temperature control function regardless of the use of the magnetic shunt alloy. On the other hand, when said Ni layer is exposed to magnetic flux that is reversed at a frequency of 20 kHz, (i) if the fixing device utilizes neither the magnetic shunt alloy layer nor the low-resistance conductive layer, an insufficient amount of heat is generated (i.e., such a fixing device is not suitable for use), and (ii) if the fixing device utilizes the magnetic shunt alloy layer and the low-resistance conductive layer, the amount of heat generated is (a) sufficient while the temperature of the magnetic shunt alloy layer is below the Curie point, but (b) adequately reduced while the temperature of the magnetic shunt alloy layer is equal to or higher than the Curie point.

Hence, the fixing device pertaining to the present embodiment has a self-temperature control function.

According to FIGS. 6A and 6B, the amount of heat generated while the temperature of the magnetic shunt alloy layer is equal to or higher than the Curie point drops to approximately 70% of the amount of heat generated while the temperature of the magnetic shunt alloy layer is below the Curie point. However, after the temperature of the magnetic shunt alloy layer has reached or exceeded the Curie point, the temperature increase in the contactless portions is suppressed, and the temperature of the contactless portions falls within an allowable temperature range. Hence, the self-temperature control function is considered to work effectively as long as the amount of heat generated while the temperature of the magnetic shunt alloy layer is equal to or higher than the Curie point drops to 80% or less of the amount of heat generated while the temperature of the magnetic shunt alloy layer is below the Curie point. Judging from FIGS. 6A and 6B, it is preferable that the heat generation material (Ni) have a thickness of approximately 10 μm to 100 μm, inclusive. For practical use, it is further preferable that the heat generation material (Ni) have a thickness of approximately 20 μm to 50 μm, inclusive. In a case where a fixed plate formed by layering a magnetic shunt alloy layer and a conductive layer is used, a phenomenon occurs where the depth by which magnetic flux penetrates into the fixed plate becomes small, even if the frequency of the magnetic flux were relatively low. Therefore, in such a case, the self-temperature control function is considered to work effectively when the frequency at which the magnetic flux generated by the excitation coil is reversed is set at approximately 10 kHz to 30 kHz, inclusive.

<Additional Remarks>

As set forth above, according to the fixing device and the image formation apparatus comprising the same pertaining to Embodiment 1, the base member for the fixing belt is made from a conductive material that is not a magnetic shunt alloy, such as Ni. This enables the fixing belt itself to generate heat and reduces heat capacity of the fixing belt to a great extent. Furthermore, while the conductive heat generation layer is embedded in the fixing belt, the magnetic shunt alloy layer and the low-resistance conductive layer are integrally layered to constitute one component (fixed plate). This structure can reduce the components positioned inside the rotation path of the fixing belt in size, and shorten the length of the fixing belt. The fixing device pertaining to Embodiment 1 thereby has the self-temperature control function with the aid of a magnetic shunt alloy, reduces the heat capacity of a heat generator as compared to conventional technologies since the belt length is short, effectively conserves energy, and promptly executes the warm-up.

Modification 1

<Overview>

A fixed plate pertaining to Modification 1 is partially different from the fixed plate pertaining to Embodiment 1. In modification 1, the layer structure of the fixed plate further includes a low-friction layer that is to slide against the fixing belt.

<Structure>

Figure 7:
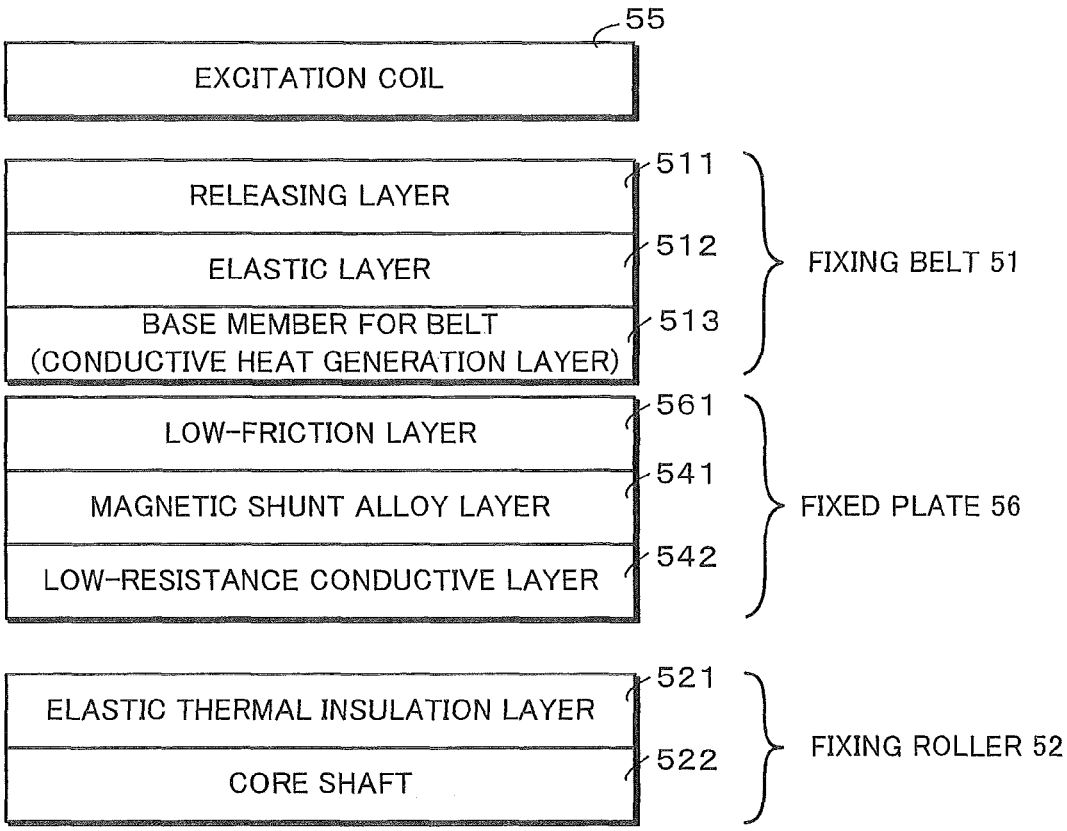
FIG. 7 is a schematic view of layer structures pertaining to Modification 1, showing the center of the fixing roller 52 through the excitation coil 55.

FIG. 7 is a schematic view of layer structures pertaining to Modification 1, showing the center of the fixing roller 52 through the excitation coil 55.

Note, in Modification 1, structural elements that are equivalent to their counterparts pertaining to Embodiment 1 have been assigned the same reference numbers, and description thereof is omitted.

The layer structures of FIG. 7 are the same as the layer structures of FIG. 3 which pertain to Embodiment 1, except that the fixed plate 54 is replaced with a fixed plate 56.

The fixed plate 56 is formed by layering a low-friction layer 561, the magnetic shunt alloy layer 541, and the low-resistance conductive layer 542 in listed order, so that the low-friction layer 561 is closest to the fixing belt 51.

The low-friction layer 561 is provided to alleviate the friction between the fixing belt 51 and the fixed plate 56. The low-friction layer 561 needs to have a smaller coefficient of sliding friction than the magnetic shunt alloy layer 541 while the fixing belt 51 is rotating. The low-friction layer 561 is preferably made of, for example, PFA that has thermostability. In the present modification, the low-friction layer 561 has a thickness of 30 μm. In terms of durability and energy conservation, it is preferable that the low-friction layer 561 have a thickness of approximately 5 μm to 100 μm, inclusive. For practical use, it is further preferable that the low-friction layer 561 have a thickness of 5 μm to 50 μm, inclusive.

As described above, in Modification 1, the fixed plate includes the low-friction layer that slides against the fixing belt. Hence, in addition to achieving the same effects as Embodiment 1, the fixing device of Modification 1 reduces the driving torque of the fixing belt, more efficiently conserves energy, and efficiently improves durability of the fixing belt and the fixed plate.

Modification 2

<Overview>

A fixing belt pertaining to Modification 2 is partially different from the fixing belt pertaining to Embodiment 1. In Modification 2, the layer structure of the fixing belt further includes a low-friction layer that is to slide against the fixed plate.

<Structure>

Figure 8:
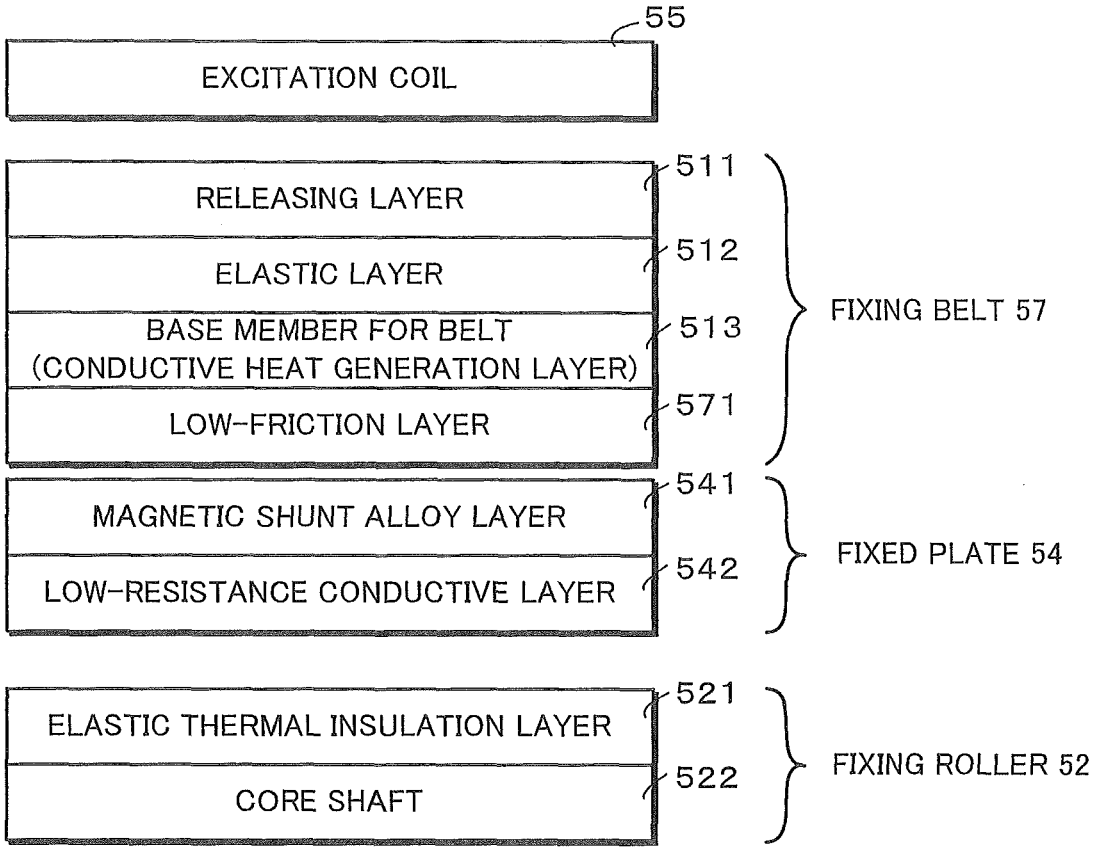
FIG. 8 is a schematic view of layer structures pertaining to Modification 2, showing the center of the fixing roller 52 through the excitation coil 55.

FIG. 8 is a schematic view of layer structures pertaining to Modification 2, showing the center of the fixing roller 52 through the excitation coil 55.

Note, in Modification 2, structural elements that are equivalent to their counterparts pertaining to Embodiment 1 have been assigned the same reference numbers, and description thereof is omitted.

The layer structures of FIG. 8 are the same as the layer structures of FIG. 3 which pertain to Embodiment 1, except that the fixing belt 51 is replaced with a fixing belt 57.

The fixing belt 57 is formed by layering the releasing layer 511, the elastic layer 512, the base member 513, and a low-friction layer 571 in listed order, so that the releasing layer 511 is closest to the excitation coil 55.

The low-friction layer 571 is provided to alleviate the friction between the fixing belt 57 and the fixed plate 54. The low-friction layer 571 needs to have a smaller coefficient of sliding friction than the base member 513 while the fixing belt 57 is rotating. Similarly to the low-friction layer 561 pertaining to Modification 1, the low-friction layer 571 is preferably made of, for example, PFA that has thermostability. In the present modification, the low-friction layer 571 has a thickness of 30 μm. In terms of durability and energy conservation, it is preferable that the low-friction layer 571 have a thickness of approximately 5 μm to 100 μm, inclusive. For practical use, it is further preferable that the low-friction layer 571 have a thickness of 5 μm to 50 μm, inclusive.

As described above, in Modification 2, the fixing belt includes the low-friction layer that slides against the fixed plate. Hence, as is the case with Modification 1, the fixing device of Modification 2 reduces the driving torque of the fixing belt, more efficiently conserves energy, and efficiently improves durability of the fixing belt and the fixed plate, in addition to achieving the same effects as Embodiment 1.

Modification 3

<Overview>

A fixed plate and a fixing belt pertaining to Modification 3 are partially different from those pertaining to Embodiment 1. In Modification 3, the layer structures of the fixing belt and the fixed plate further include low-friction layers that are to slide against each other.

<Structure>

Figure 9:
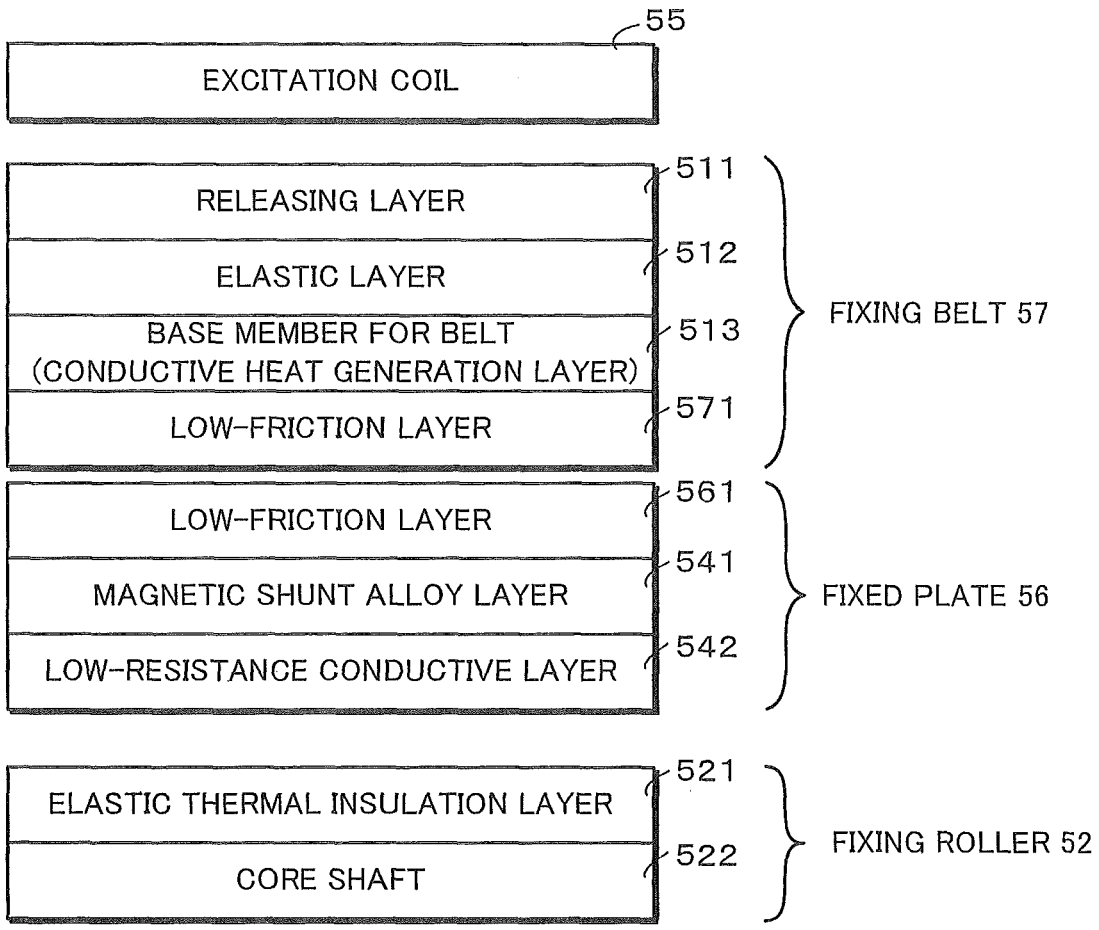
FIG. 9 is a schematic view of layer structures pertaining to Modification 3, showing the center of the fixing roller 52 through the excitation coil 55.

FIG. 9 is a schematic view of layer structures pertaining to Modification 3, showing the center of the fixing roller 52 through the excitation coil 55.

Note, in Modification 3, structural elements that are equivalent to their counterparts pertaining to Embodiment 1 and Modifications 1 and 2 have been assigned the same reference numbers, and description thereof is omitted.

The layer structures of FIG. 9 are the same as the layer structures of FIG. 3 which pertaining to Embodiment 1, except that the fixed plate 54 and the fixing belt 51 are replaced with a fixed plate 56 and a fixing belt 57, respectively.

As described above, in Modification 3, the fixing belt and the fixed plate include the low-friction layers that slide against each other. Hence, as is the case with Modifications 1 and 2, the fixing device of Modification 3 reduces the driving torque of the fixing belt, more efficiently conserves energy, and efficiently improves durability of the fixing belt and the fixing belt, in addition to achieving the same effects as Embodiment 1.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device for causing a sheet, on which an unfixed image has been formed, to pass through a fixing nip, and thus thermally fixing the unfixed image onto the sheet, the fixing device comprising:

a belt that is heated by electromagnetic induction while being driven to rotate;

a first member positioned inside a closed rotation path of the belt;

a second member operable to form the fixing nip between an outer surface of the belt and the second member by pressing the first member from outside the closed rotation path of the belt with the belt in between the first member and the second member;

an excitation coil positioned outside the closed rotation path of the belt; and a fixed plate that (i) is positioned inside the closed rotation path of the belt, substantially facing the excitation coil with the belt in between the excitation coil and the fixed plate, (ii) comes into contact with an inner surface of the belt, and (iii) keeps the belt on the closed rotation path, wherein the belt includes, as a base member, a conductive heat generation layer that (i) generates heat due to an eddy current induced by magnetic flux generated by the excitation coil, and (ii) does not contain a magnetic shunt alloy, and the fixed plate has a layer structure including (i) a conductive layer and (ii) a magnetic shunt alloy layer that is closer to the belt than the conductive layer.

2. The fixing device of claim 1, wherein the magnetic shunt alloy layer is (i) ferromagnetic when a temperature thereof is below a Curie point, and (ii) non-magnetic when the temperature thereof is equal to or higher than the Curie point, and an amount of heat generated in the conductive heat generation layer when the magnetic shunt alloy layer is non-magnetic is 80% or less of an amount of heat generated in the conductive heat generation layer when the magnetic shunt alloy layer is ferromagnetic.

3. The fixing device of claim 1, wherein the conductive heat generation layer is made of nickel and has a thickness ranging between 10 μm and 100 μm, inclusive.

4. The fixing device of claim 3, wherein the magnetic flux generated by the excitation coil has a frequency ranging between 10 kHz and 30 kHz, inclusive.

5. The fixing device of claim 1, wherein the magnetic shunt alloy layer is made of either a Ni—Fe alloy or a Ni—Fe—Cr alloy, and a Curie point of the magnetic shunt alloy layer ranges between 180° C. and 240° C., inclusive.

6. The fixing device of claim 1, wherein the layer structure of the fixed plate is composed of at least three layers, including (i) the conductive layer, (ii) the magnetic shunt alloy layer, and (iii) a low-friction layer that is closer to the belt than any other layer of the fixed plate, the low-friction layer having a smaller coefficient of sliding friction than the magnetic shunt alloy layer while the belt is rotating, and the inner surface of the belt and the low-friction layer slide against each other while the belt is rotating.

7. The fixing device of claim 6, wherein the low-friction layer is made of fluororesin.

8. The fixing device of claim 1, wherein the belt has a layer structure composed of at least two layers, including (i) the base member and (ii) a low-friction layer that is closer to the fixed plate than the base member, the low-friction layer having a smaller coefficient of sliding friction, than the base member while the belt is rotating, and the fixed plate and the low-friction layer slide against each other while the belt is rotating.

9. The fixing device of claim 1, wherein the layer structure of the fixed plate is composed of at least three layers, including (i) the conductive layer, (ii) the magnetic shunt alloy layer, and (iii) a first low-friction layer that is closer to the belt than any other layer of the fixed plate, the first low-friction layer having a smaller coefficient of sliding friction than the magnetic shunt alloy layer while the belt is rotating, the belt has a layer structure composed of at least two layers, including (i) the base member and (ii) a second low-friction layer that is closer to the fixed plate than the base member, the second low-friction layer having a smaller coefficient of sliding friction than the base member while the belt is rotating, and the first low-friction layer and the second low-friction layer slide against each other while the belt is rotating.

10. The fixing device of claim 1, wherein in a cross-sectional plane perpendicular to a rotation axis of the belt, the belt has a substantially elliptical shape satisfying the following relationship: a major axis≦a minor axis×2.

11. An image formation apparatus that includes a fixing device for causing a sheet, on which an unfixed image has been formed, to pass through a fixing nip, and thus thermally fixing the unfixed image onto the sheet, wherein the fixing device comprises:

a belt that is heated by electromagnetic induction while being driven to rotate;

a first member positioned inside a closed rotation path of the belt;

a second member operable to form the fixing nip between an outer surface of the belt and the second member by pressing the first member from outside the closed rotation path of the belt with the belt in between the first member and the second member;

an excitation coil positioned outside the closed rotation path of the belt; and a fixed plate that (i) is positioned inside the closed rotation path of the belt, substantially facing the excitation coil with the belt in between, (ii) comes into contact with an inner surface of the belt, and (iii) keeps the belt on the closed rotation path, the belt includes, as a base member, a conductive heat generation layer that (i) generates heat due to an eddy current induced by magnetic flux generated by the excitation coil, and (ii) does not contain a magnetic shunt alloy, and the fixed plate has a layer structure including (i) a conductive layer and (ii) a magnetic shunt alloy layer that is closer to the belt than the conductive layer.

12. The image forming apparatus of claim 11, wherein the magnetic shunt alloy layer is (i) ferromagnetic when a temperature thereof is below a Curie point, and (ii) nonmagnetic when the temperature thereof is equal to or higher than the Curie point, and an amount of heat generated in the conductive heat generation layer when the magnetic shunt alloy layer is nonmagnetic is 80% or less of an amount of heat generated in the conductive heat generation layer when the magnetic shunt alloy layer is ferromagnetic.

13. The image forming apparatus of claim 11, wherein the conductive heat generation layer is made of nickel and has a thickness ranging between 10 μm and 100 μm, inclusive.

14. The image forming apparatus of claim 13, wherein the magnetic flux generated by the excitation coil has a frequency ranging between 10 kHz and 30 kHz, inclusive.

15. The image forming apparatus of claim 11, wherein the magnetic shunt alloy layer is made of either a Ni—Fe alloy or a Ni—Fe—Cr alloy, and a Curie point of the magnetic shunt alloy layer ranges between 180° C. and 240° C., inclusive.

16. The image forming apparatus of claim 11, wherein the layer structure of the fixed plate is composed of at least three layers, including (i) the conductive layer, (ii) the magnetic shunt alloy layer, and (iii) a low-friction layer that is closer to the belt than any other layer of the fixed plate, the low-friction layer having a smaller coefficient of sliding friction than the magnetic shunt alloy layer while the belt is rotating, and the inner surface of the belt and the low-friction layer slide against each other while the belt is rotating.

17. The image forming apparatus of claim 16, wherein the low-friction layer is made of fluororesin.

18. The image forming apparatus of claim 11, wherein the belt has a layer structure composed of at least two layers, including (i) the base member and (ii) a low-friction layer that is closer to the fixed plate than the base member, the low-friction layer having a smaller coefficient of sliding friction, than the base member while the belt is rotating, and the fixed plate and the low-friction layer slide against each other while the belt is rotating.

19. The image forming apparatus of claim 11, wherein the layer structure of the fixed plate is composed of at least three layers, including (i) the conductive layer, (ii) the magnetic shunt alloy layer, and (iii) a first low-friction layer that is closer to the belt than any other layer of the fixed plate, the first low-friction layer having a smaller coefficient of sliding friction than the magnetic shunt alloy layer while the belt is rotating, the belt has a layer structure composed of at least two layers, including (i) the base member and (ii) a second low-friction layer that is closer to the fixed plate than the base member, the second low-friction layer having a smaller coefficient of sliding friction than the base member while the belt is rotating, and the first low-friction layer and the second low-friction layer slide against each other while the belt is rotating.

20. The image forming apparatus of claim 11, wherein in a cross-sectional plane perpendicular to a rotation axis of the belt, the belt has a substantially elliptical shape satisfying the following relationship: a major axis≦a minor axis×2.

21. A fixing device for causing a sheet, on which an unfixed image has been formed, to pass through a fixing nip, and thus thermally fixing the unfixed image onto the sheet, the fixing device comprising;

a belt that is heated by electromagnetic induction and is driven to rotate;

a first member positioned inside a closed rotation path of the belt;

a second member operable to form the fixing nip between an outer surface of the belt and the second member by pressing the first member from outside the closed rotation path of the belt with the belt in between the first member and the second member;

an excitation coil positioned outside the closed rotation path of the belt; and a third member that is fixedly positioned inside the closed rotation path of the belt, substantially facing the excitation coil with the belt in between the excitation coil and the third member, wherein the belt includes a conductive heat generation layer that generates heat due to an eddy current induced by magnetic flux generated by the excitation coil, and does not include a layer containing a magnetic shunt alloy, and the third member has a conductive layer and a magnetic shunt alloy layer that is closer to the belt than the conductive layer.

22. The fixing device of claim 21, wherein the magnetic shunt alloy layer is (i) ferromagnetic when a temperature thereof is below a Curie point, and (ii) nonmagnetic when the temperature thereof is equal to or higher than the Curie point, and an amount of heat generated in the conductive heat generation layer when the magnetic shunt alloy layer is nonmagnetic is 80% or less of an amount of heat generated in the conductive heat generation layer when the magnetic shunt alloy layer is ferromagnetic.

23. The fixing device of claim 21, wherein the conductive heat generation layer is made of nickel and has a thickness ranging between 10 μm and 100 μm, inclusive.

24. The fixing device of claim 23, wherein the magnetic flux generated by the excitation coil has a frequency ranging between 10 kHz and 30 kHz, inclusive.

25. The fixing device of claim 21, wherein the magnetic shunt alloy layer is made of either a Ni-Fe alloy or a Ni-Fe-Cr alloy, and a Curie point of the magnetic shunt alloy layer ranges between 180° C. and 240° C., inclusive.

26. The fixing device of claim 21, wherein the third member includes (i) the conductive layer, (ii) the magnetic shunt alloy layer, and (ill) a low-friction layer that is closer to the belt than any other layer of the third member, the low-friction layer having a smaller coefficient of sliding friction than the magnetic shunt alloy layer while the belt is rotating, and the inner surface of the belt and the low-friction layer slide against each other while the belt is rotating.

27. The fixing device of claim 26, wherein the low-friction layer is made of fluororesin.

28. The fixing device of claim 21, wherein the belt includes (i) the conductive heat generation layer and (ii) a low-friction layer that is closer to the third member than the conductive heat generation layer, the low-friction layer having a smaller coefficient of sliding friction, than the conductive heat generation layer while the belt is rotating, and the third member and the low-friction layer slide against each other while the belt is rotating.

29. The fixing device of claim 21, wherein the third member includes (i) the conductive layer, (ii) the magnetic shunt alloy layer, and (iii) a first low-friction layer that is closer to the belt than any other layer of the third member, the first low-friction layer having a smaller coefficient of sliding friction than the magnetic shunt alloy layer while the belt is rotating, the belt includes (i) the conductive heat generation layer and (ii) a second low-friction layer that is closer to the third member than the conductive heat generation layer, the second low-friction layer having a smaller coefficient of sliding friction than the conductive heat generation layer while the belt is rotating, and the first low-friction layer and the second low-friction layer slide against each other while the belt is rotating.

30. The fixing device of claim 21, wherein in a cross-sectional plane perpendicular to a rotation axis of the belt, the belt has a substantially elliptical shape satisfying the following relationship; a major axis ≦ a minor axis × 2.

31. The fixing device of claim 21, wherein the third member is made of a plate which has a layer structure composed of at least two layers including the conductive layer and the magnetic shunt alloy layer.

32. The fixing device of claim 31, wherein the conductive heat generation layer is made of nickel and has a thickness ranging between 10 pm and 100 pm, inclusive.

33. The fixing device of claim 31, wherein the magnetic flux generated by the excitation coil has a frequency ranging between 10 kHz and 30 kHz, inclusive.

34. The fixing device of claim 21, wherein the magnetic shunt alloy layer has a thickness ranging between 50 μm and 400 μm, inclusive, and the conductive layer has a thickness ranging between 50 μm and 400 μm, inclusive.

35. The fixing device of claim 21, wherein the conductive layer and the magnetic shunt alloy layer contact each other.

36. An image formation apparatus that includes a fixing device for causing a sheet, on which an unfixed image has been formed, to pass through a fixing nip, and thus thermally fixing the unfixed image onto the sheet, wherein the fixing device comprises:

a belt that is heated by electromagnetic induction and is driven to rotate;

a first member positioned inside a closed rotation path of the belt;

a second member operable to form the fixing nip between an outer surface of the belt and the second member by pressing the first member from outside the closed rotation path of the belt with the belt in between the first member and the second member;

an excitation coil positioned outside the closed rotation path of the belt; and a third member that is fixedly positioned inside the closed rotation path of the belt, substantially facing the excitation coil with the belt in between the excitation coil and the third member, the belt includes a conductive heat generation layer that generates heat due to an eddy current induced by magnetic flux generated by the excitation coil, and does not include a layer containing a magnetic shunt alloy, and the third member has a conductive layer and a magnetic shunt alloy layer that is closer to the belt than the conductive layer.

37. The image forming apparatus of claim 36, wherein the magnetic shunt alloy layer is (i) ferromagnetic when a temperature thereof is below a Curie point, and (ii) nonmagnetic when the temperature thereof is equal to or higher than the Curie point, and an amount of heat generated in the conductive heat generation layer when the magnetic shunt alloy layer is nonmagnetic is 80% or less of an amount of heat generated in the conductive heat generation layer when the magnetic shunt alloy layer is ferromagnetic.

38. The image forming apparatus of claim 36, wherein the conductive heat generation layer is made of nickel and has a thickness ranging between 10 μm and 100 μm, inclusive.

39. The image forming apparatus of claim 38, wherein the magnetic flux generated by the excitation coil has a frequency ranging between 10 kHz and 30 kHz, inclusive.

40. The image forming apparatus of claim 36, wherein the magnetic shunt alloy layer is made of either a Ni-Fe alloy or a Ni-Fe-Cr alloy, and a Curie point of the magnetic shunt alloy layer ranges between 180° C. and 240° C., inclusive.

41. The image forming apparatus of claim 36, wherein the third member includes (i) the conductive layer, (ii) the magnetic shunt alloy layer, and (iii) a low-friction layer that is closer to the belt than any other layer of the third member, the low-friction layer having a smaller coefficient of sliding friction than the magnetic shunt alloy layer while the belt is rotating, and the inner surface of the belt and the low-friction layer slide against each other while the belt is rotating.

42. The image forming apparatus of claim 41, wherein the low-friction layer is made of fluororesin.

43. The image forming apparatus of claim 36, wherein the belt includes (i) the conductive heat generation layer and (ii) a low-friction layer that is closer to the third member than the conductive heat generation layer, the low-friction layer having a smaller coefficient of sliding friction, than the conductive heat generation layer while the belt is rotating, and the third member and the low-friction layer slide against each other while the belt is rotating.

44. The image forming apparatus of claim 36 wherein the third member includes (i) the conductive layer, (ii) the magnetic shunt alloy layer, and (iii) a first low-friction layer that is closer to the belt than any other layer of the third member, the first low-friction layer having a smaller coefficient of sliding friction than the magnetic shunt alloy layer while the belt is rotating, the belt includes (i) the conductive heat generation layer and (ii) a second low- friction layer that is closer to the third member than the conductive heat generation layer, the second low-friction layer having a smaller coefficient of sliding friction than the conductive heat generation layer while the belt is rotating, and the first low-friction layer and the second low-friction layer slide against each other while the belt is rotating.

45. The image forming apparatus of claim 36, wherein in a cross-sectional plane perpendicular to a rotation axis of the belt, the belt has a substantially elliptical shape satisfying the following relationship; a major axis $\leqq$ a minor axis $\times$ 2.

46. The image forming apparatus of claim 36, wherein the third member is a plate which has a layer structure composed of at least two layers including the conductive layer and the magnetic shunt alloy layer.

47. The image forming apparatus of claim 46, wherein the conductive heat generation layer is made of nickel and has a thickness ranging between 10 μm and 100 μm, inclusive.

48. The image forming apparatus of claim 46, wherein the magnetic flux generated by the excitation coil has a frequency ranging between 10 kHz and 30 kHz, inclusive.

49. The image forming apparatus of claim 36, wherein the magnetic shunt alloy layer has a thickness ranging between 50 μm and 400 μm, inclusive, and the conductive layer has a thickness ranging between 50 μm and 400 μm, inclusive.

50. The image forming apparatus of claim 36, wherein the conductive layer and the magnetic shunt alloy layer contact each other.

* * * * *